US009593568B1

(12) United States Patent
LeMonds et al.

(10) Patent No.: US 9,593,568 B1
(45) Date of Patent: Mar. 14, 2017

(54) SYSTEM FOR ESTIMATING FATIGUE DAMAGE

(71) Applicant: GENERAL ELECTRIC COMPANY, Schenectady, NY (US)

(72) Inventors: Jeffrey LeMonds, Clifton Park, NY (US); Judith Ann Guzzo, Niskayuna, NY (US); Shaopeng Liu, Clifton Park, NY (US); Uttara Ashwin Dani, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 14/879,239

(22) Filed: Oct. 9, 2015

(51) Int. Cl.
*E21B 17/01* (2006.01)
*E21B 47/00* (2012.01)

(52) U.S. Cl.
CPC ..... *E21B 47/0006* (2013.01); *E21B 17/01* (2013.01)

(58) Field of Classification Search
CPC ... E21B 17/01; E21B 47/0001; E21B 47/0006
See application file for complete search history.

(56) References Cited

U.S. PATENT DOCUMENTS 5,978,739 A * 11/1999 Stockton ..... E21B 19/002 701/116
7,080,689 B2 * 7/2006 Guesnon ..... E21B 17/01 166/355
7,328,741 B2 * 2/2008 Allen ..... E21B 44/00 166/335
7,398,697 B2 * 7/2008 Allen ..... E21B 17/01 73/800

(Continued)

FOREIGN PATENT DOCUMENTS

JP 2014112061 A * 6/2014
NO WO 2014064190 A2 * 5/2014 ..... E21B 41/0007

OTHER PUBLICATIONS

Brower, "Real-time fatigue monitoring of deepwater drilling and oil production risers using fiber-optic sensors", Structural Health Monitoring 2003: Diagnostics & Prognostics to Structural Health Management: Proceedings of the 4th International Workshop, 8 pgs., 2003, Lancaster, PA.

(Continued)

*Primary Examiner* — Matthew R Buck
(74) *Attorney, Agent, or Firm* — Andrew J. Caruso

(57) ABSTRACT

In one aspect, a system for estimating fatigue damage in a riser string is provided. The system includes a plurality of accelerometers which can be deployed along a riser string and a communications link to transmit accelerometer data from the plurality of accelerometers to one or more data processors in real time. With data from a limited number of accelerometers located at sensor locations, the system estimates an optimized current profile along the entire length of the riser including riser locations where no accelerometer is present. The optimized current profile is then used to estimate damage rates to individual riser components and to update a total accumulated damage to individual riser components. The number of sensor locations is small relative to the length of a deepwater riser string, and a riser string several miles long can be reliably monitored along its entire length by fewer than twenty sensor locations.

22 Claims, 5 Drawing Sheets

(56) References Cited

U.S. PATENT DOCUMENTS 7,721,611 B2 * 5/2010 Salama ..... E21B 17/01 73/862.627
8,074,720 B2 * 12/2011 Radi ..... E21B 19/004 166/250.01
9,279,666 B1 3/2016 Balasubramaniam et al.
2005/0283276 A1 * 12/2005 Prescott ..... E21B 47/06 700/282
2006/0177275 A1 * 8/2006 Allen ..... B63B 21/502 405/224.2
2007/0193363 A1 * 8/2007 Allen ..... B63B 9/00 73/825
2012/0303293 A1 * 11/2012 McNeill ..... E21B 17/01 702/34
2013/0287501 A1 * 10/2013 Brower ..... E21B 17/01 405/216
2013/0327533 A1 * 12/2013 Veeningen ..... E21B 47/1025 166/345
2015/0176237 A1 * 6/2015 Li ..... E02B 17/0017 702/34

OTHER PUBLICATIONS

Baldwin et al., "Review of Fiber Optic Accelerometers", Proceedings of IMAC XXIII: A Conference & Exposition on Structural Dynamicsm, pp. 1-7, 2005.
Christiansen et al., "Comparison of Neural Network Error Measures for Simulation of Slender Marine Structures", Journal of Applied Mathematics, vol. No. 2, Issue No. 6, pp. 1-12, Jan. 1, 2014.
PCT Search Report and Written Opinion issued in connection with corresponding PCT Application No. PCT/US16/037475 on Sep. 29, 2016.

* cited by examiner

*Fig. 5A*
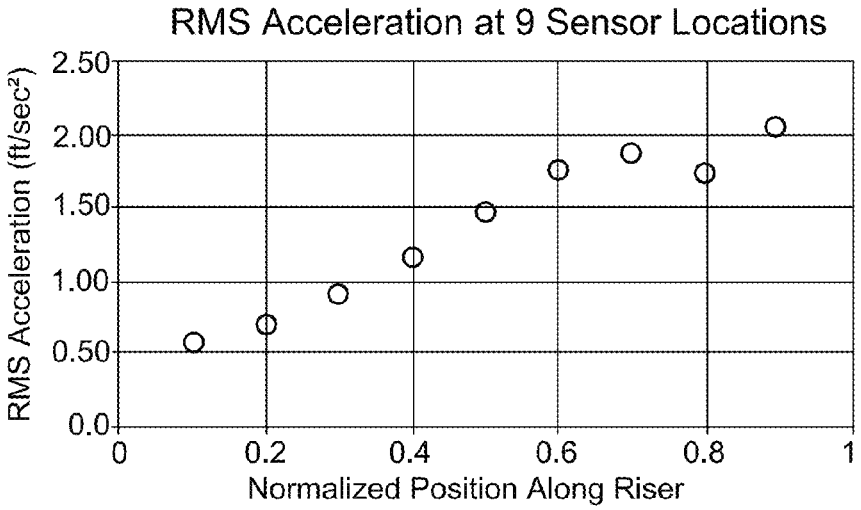
*Fig. 5B*
$$\phi = \sum_{i=1}^{N_S} (\hat{a}_i(c_1, c_{2,\ldots}) - \bar{a}_i)^2$$
$$C_j, j=1,N_c$$
*Fig. 5C*
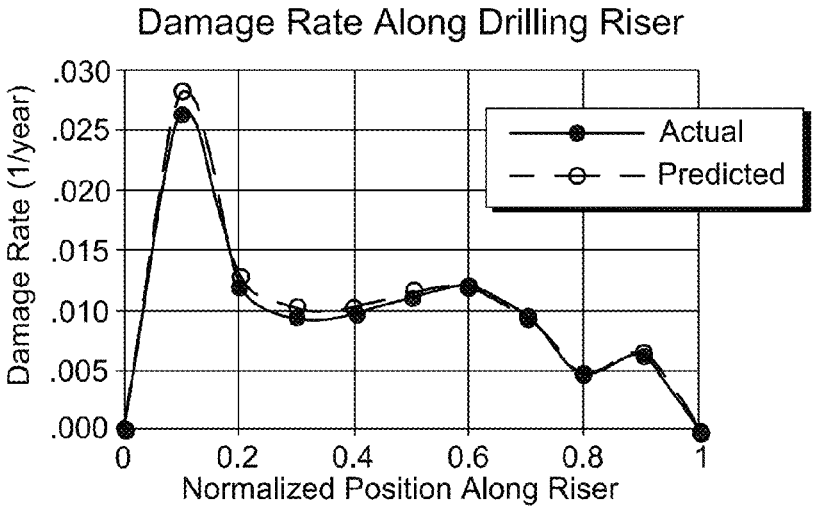

SYSTEM FOR ESTIMATING FATIGUE DAMAGE

STATEMENT REGARDING FEDERALLY SPONSORED RESEARCH & DEVELOPMENT

This invention was made with Government support under RPSEA contract number 11121-5402 awarded by the United States Department of Energy. The Government has certain rights in this invention.

BACKGROUND

The present invention relates to monitoring damage to subsea equipment. In a particular aspect the present invention relates to monitoring fatigue in subsea riser strings in real time.

The prediction and monitoring of fatigue damage resulting from vortex-induced vibrations (VIV) of drilling risers is a complex and a challenging problem in deepwater drilling environments. Although multiple sources of fatigue damage exist, VIV and waves are the primary causes of fatigue damage to deepwater drilling risers. Undersea currents can result in VIV in which the drilling riser vibrates in a direction perpendicular to the dominant current direction. Unlike shallow environments, deepwater drilling requires relatively high top tension to maintain lateral stability of the riser string. This high tension in combination with stresses produced by strong currents may result in components of the subsurface installation served by the riser string (e.g. BOP-stack-conductor) vibrating at or near a component resonant frequency and lead to in increased rates of fatigue damage and increased susceptibility of the overall system to fatigue failure.

At present, drilling riser monitoring systems use vibration data loggers that provide data on stresses experienced along the riser string after the loggers are recovered at the end of a drilling campaign. Real time data is generally not available with which to continuously assess damage being accumulated along the length of the riser. As a result, assessment of fatigue damage occurring during a drilling campaign often relies upon predictive models applied before the drilling campaign is begun. In the face of such uncertainty, damage rate estimates are relatively conservative and tend to exceed actual damage rates, thereby limiting both riser life and riser operational flexibility.

Thus, there is a need for systems and methods for reliably determining damage rates in marine risers in real time. The present invention provides new systems and methods which address one or more of the aforementioned problems.

BRIEF DESCRIPTION

In one or more embodiments, the present invention provides a system for estimating fatigue damage in a riser string, the system comprising: (a) a plurality of accelerometers configured to be deployed along a riser string; (b) a communications link configured to transmit accelerometer data in real time from the plurality of accelerometers; and (c) one or more data processors configured to receive the accelerometer data in real time and to estimate therefrom an optimized current profile along the riser string, and to estimate damage rates to individual riser components based upon the optimized current profile, and to update a total accumulated damage to individual riser string components.

In one or more alternate embodiments, the present invention provides a system for estimating fatigue damage in a riser string, the system comprising: (a) a plurality of accelerometers configured to be deployed along a riser string; (b) a wireless communications link configured to transmit accelerometer data in real time from the plurality of accelerometers; (c) one or more data processors configured to receive the accelerometer data in real time and to estimate therefrom an optimized current profile along the riser string, and to estimate damage rates to individual riser components based upon the optimized current profile, and to update a total accumulated damage to individual riser string components; wherein the optimized current profile is generated using one or more machine learning techniques, and wherein at least one of the data processors is configured to provide as a system output one or more graphical data summaries.

In yet another set of embodiments, the present invention provides a method of producing a hydrocarbon-containing fluid, the method comprising: (a) drilling a production well while estimating fatigue damage in a riser string using a system comprising: (i) a plurality of accelerometers deployed along a riser string; (ii) a communications link transmitting accelerometer data in real time from the plurality of accelerometers; and (iii) one or more data processors receiving the accelerometer data in real time and estimating therefrom an optimized current profile along the riser string, and estimating damage rates to individual riser components based upon the optimized current profile, and updating a total accumulated damage to individual riser string components; (b) completing the production well; and (c) causing a hydrocarbon-containing fluid to flow from the production well to a storage facility.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems which comprising one or more embodiments of the invention. As such, the drawings are not meant to include all conventional features known by those of ordinary skill in the art to be required for the practice of the invention.

FIG. 5A, FIG. 5B and FIG. 5C illustrate methodology used according to one or more embodiments of the present invention.

DETAILED DESCRIPTION

Figure 1:
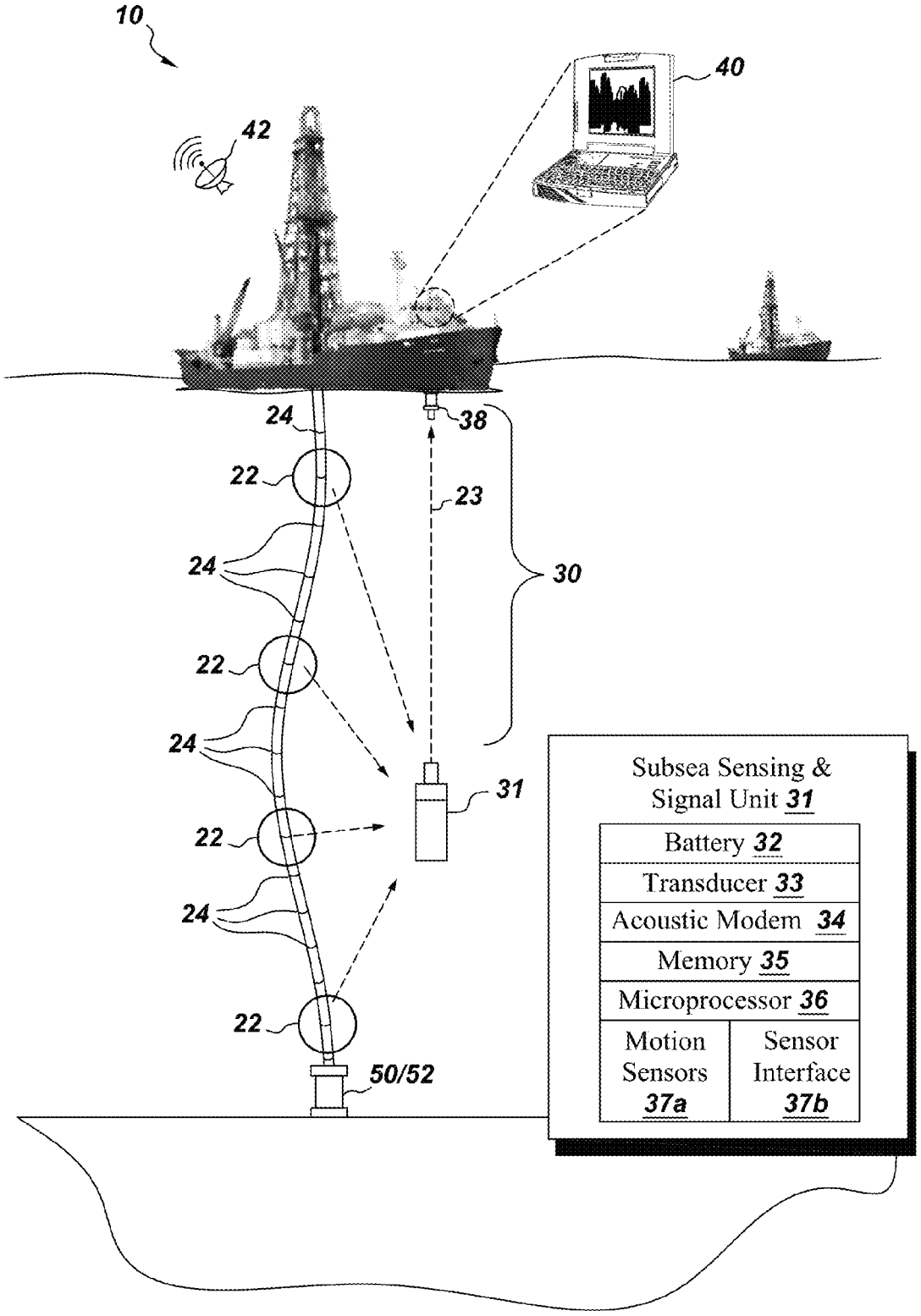
FIG. 1 illustrates one or more embodiments of the present invention.

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

In one or more embodiments, the present invention provides a system with software intelligence for performing real-time riser lifecycle monitoring. The system receives data collected from a limited array of accelerometers deployed along the riser string and employs advanced data analytics to predict the fatigue damage resulting from vortex-induced vibration (VIV) for all components of the riser whether the riser component is in close proximity to an accelerometer or not. Critical information such as damage along the string and the remaining useful life of the riser string is calculated and graphically displayed. The system may prompt the scheduling of inspections of the riser string and may identify which components of the riser string are most likely to exhibit fatigue damage, and whether particular components should be repaired, replaced, or interchanged with other components at the time of the next inspection of the riser.

The system for estimating fatigue damage in a riser string provided by the present invention enables an operator to make decisions based on real-time damage and life predictions for essentially all of the components of the riser string. In one or more embodiments, the system records the riser string configuration, uniquely identifying each of the components of the riser string, its position within the riser string and its material properties. Further, the system comprises analytics tools to create a model capable of estimating in real time the acceleration characteristics of each component of the specified riser string configuration. The system uses the acceleration characteristics derived from the model to predict damage rates for each component of the specified riser string configuration and to record total accumulated damage to such components over time. In one or more embodiments, the system provides for a visual display in real time of damage-related riser characteristics, for example, real time damage levels (damage rates and total accumulated damage) of individual components of the riser string and the remaining useful life of such components. In one or more embodiments, the system comprises a top-side data processor which presents the visual display in real time to a rig operator. In one or more embodiments, the visual display includes recommendations to the rig operator based on the current state of damage, which as noted, may include damage to riser string components accumulated in previous deployments.

In one or more embodiments, the riser string houses the drilling apparatus and includes a series of connected components, starting with a conductor, a wellhead and a blowout preventer near the ocean floor, and progressing upward through the water column to a tension ring and telescopic joint in close proximity to the ocean surface. In one or more embodiments, the riser string may comprise one or more buoyed joints and/or slick joints. During drilling, the riser string is used to conduct fresh drilling fluid into the well bore and to convey drilling fluid containing solids generated by the action of the drill bit within the well bore back to the surface for treatment and recycle. Typically, drilling fluid containing such solids is returned to a topside facility where the mixture is separated and the drilling fluid is returned to the riser string as fresh drilling fluid. In practice, a drilling riser string is used for a few months during a particular drilling campaign, and thereafter is dismantled and moved to another location for the next drilling campaign.

Because each riser string component is susceptible to being used in multiple drilling or production campaigns and at different locations within the riser string, each riser string component is identified by a unique and permanent digital identifier, typically in the form of an alphanumeric string. In the practice of the present invention, an initial system input consists of the unique identifiers of each of the components in the riser string. In one or more embodiments, the system includes a master database that contains the geometric and material properties of each component that are needed for vibration and lifing calculations, as well as the calculated damage levels accumulated by the particular component in prior deployments.

In one aspect, the present invention predicts damage rates to individual components of the riser string in real time. To do so, the system estimates vibratory accelerations, stresses and the associated damage rates that would result from contact between the riser string and a hypothetical current profile extending from the ocean surface to the ocean floor using one or more modeling tools which evaluate the vibration modes likely to be excited by vortex shedding in order to predict the localized vortex induced vibration (VIV) levels used to estimate local damage rates. One such modeling tool is the well-known mode superposition program Shear7 which can be used to predict vortex induced vibrations which are in turn used to predict damage rates. In practice, measuring currents at and near the ocean surface is possible, but it is generally not feasible to measure the entire subsea current profile to which a riser string will be subjected. Thus, in one aspect, the system provided by the present invention accurately estimates the current profile the riser string actually experiences and uses this estimated current profile to accurately predict damage rates to individual riser string components.

A variety of machine learning tools may be employed to accurately estimate the optimized current profile including neural network models, support vector machines, and Bayesian analysis. The discussion immediately following is directed toward generating the optimized current profile using one or more neural network models. Those of ordinary skill in the art will understand that support vector machines and Bayesian analysis can be applied analogously to achieve the same result.

In one or more embodiments, a neural network model is used to accurately estimate the current profile that is then used to estimate damage rates to individual riser components. The inputs to the neural network model are current intensities taken from the hypothetical current profile experienced by the riser string, and the outputs of the neural network model are predicted acceleration characteristics along the length of the riser string, including those locations along the riser string where one of the limited number of accelerometers is actually present. The neural network model varies current intensity inputs along the length of the riser string and finds the closest match between the calculated acceleration characteristics of the riser locations where an accelerometer is actually present (sensor locations), and the acceleration characteristic reported by the accelerometer from those sensor locations. Because the accelerometers, though limited in number, are arrayed to reflect the current profile near the ocean surface, near the ocean floor and a limited number of locations therein between, it is possible using this neural network model to estimate the current profile experienced by the riser string with a substantial level of confidence. Greater certainty with respect to the current profile might be obtained using a larger number of accelerometers but this would add cost and complexity to the riser string and its deployment. As noted, once the neural network model identifies the current profile providing the closest match between the calculated acceleration characteristics of the riser locations where an accelerometer is present, and the acceleration characteristic reported by the accelerometer from those locations, the flow characteristics of the optimized current profile may be used to calculate damage rates to riser string components along the entire length of the riser string in real time.

In one or more embodiments, the optimized current profile is generated using one or more machine learning techniques including one or more neural network models, one or more support vector machines, one or more Bayesian analyses, or a combination of two or more of the foregoing analytical techniques In the practice of one or more embodiments of the present invention, when a new riser configuration is input into the system, the system creates one or more corresponding neural network models for the prediction of acceleration characteristics at each location on the riser string where an accelerometer is present (sensor locations). A space-filling design of experiments (DOE) is generated that includes a variety current profiles representative of the geographical region in which the drilling campaign is to be conducted. The data set for the DOE containing the reported accelerometer data may be used to train the neural network model, to cross-validate and tune neural network model internal parameters, and to validate neural network model outputs. In one or more embodiments, the neural network model may include one or more variables of a specific riser string deployment, for example; specific riser component geometries, riser component material properties, top-tension levels and drilling fluid weights.

As noted, the neural network model calculates acceleration characteristics at each sensor location on the riser string based on current intensities of a hypothetical current profile. Acceleration data are collected from the limited number of accelerometers deployed along the riser string, and these data are compared to the acceleration characteristics calculated from the hypothetical current profile. A constrained optimization problem (equation 1) is performed that minimizes $\phi$, the sum of the squares of the differences between the predicted and the measured acceleration characteristics, wherein the two $a_i$ terms are the predicted and the measured acceleration characteristics at the $i^{th}$ sensor location among a total of N sensors, and $c_1$, $c_2$, . . . are the model current intensities applied along the entire length of the riser.

$$\phi = \sum_{i=1}^{n_S} (\hat{a}_1(c_1, c_2, \ldots) - \bar{a}_i)^2 \tag{1}$$

This process yields a current profile, expressed as a set of current intensities ($c_{1'}$, $c_{2'}$, $c_{3'}$, . . . ) along the entire length of the riser string that most closely matches the acceleration characteristics reported by the accelerometer at each of the sensor locations. Once this optimized current profile has been obtained, a computational fluid dynamics program capable of using the calculated current intensities is employed to calculate stresses and damage rates for each component in the riser string. Damage increments are then calculated assuming constant damage rates during the period of time over which the sensor data is taken (typically a duration on the order of minutes). The total damage for each component is updated and entered into the master database.

In one or more embodiments, the system provided by the present invention presents several key top-level displays of the present state of riser damage and the overall maximum damage history of the riser and its various components, and does so essentially in real time. For example, the system may display a present state of damage along the riser string at a specific point in time or at multiple points in time. In one embodiment, the system displays the maximum damage history in the riser. For example, the system may display the maximum damage among all of the components in the riser configuration as a function of time. The system may display the average damage versus time (with the assumption that the riser ages at a constant rate over its design life) and compare this with the predicted overall maximum damage. Under such circumstances, the system may recommend an inspection interval based on a moving average of damage rates over the recent past, and an estimate of the remaining useful life of the riser and its components. Where, for example, the riser appears to have aged at a rate faster than anticipated, a reduction in the planned time to the next inspection may be recommended by the system, and the predicted remaining useful life of the riser string may be updated.

In situations in which the system predicts that some components have experienced substantially more damage than others, the system may recommend that the components with higher predicted degrees of damage be exchanged with components with lower predicted degrees of damage in the following inspection and maintenance cycle (assuming that damage levels are not so acute as to require intervention at an earlier point in time). Thus, the system provided by the present invention offers a significant benefit to operators in that it can help avoid the premature onshore repair or decommissioning of riser string components which remain serviceable despite having sustained significant levels of damage.

Turning now to the figures, FIG. 1 illustrates various embodiments of a system provided by the present invention comprising a wireless communications link. In the embodiment shown, a system 10 for estimating fatigue damage in a riser string 20, comprises a plurality of accelerometers 22 deployed at intervals along the riser string 20. In the embodiment shown, locations along the riser string for which acceleration characteristics are to be estimated (rather than measured by an accelerometer) are designated by element number 24. Accelerometer data 23 are transferred in real time to one or more topside data processors 40 via wireless communications link 30. Communications link 30 comprises an acoustic receiver 38 and subsea sensing and signal unit 31. Sensing and signal units 31 measure the acceleration characteristics of the riser string at each of the limited number of locations along the riser string to which a sensing and signal unit is attached, and may transmit this data in real time, meaning that data 23 may be continuously transmitted, or data may be gathered and stored briefly within the subsea sensing and signal unit 31 and then transmitted to the one or more data processors 40. Where accelerometer data are not transmitted immediately after being gathered, time intervals between data transmissions are small relative to the length of the drilling or production campaign being monitored and are typically on the order of minutes. In one or more embodiments, this time interval is less than ten minutes. In one or more embodiments, system 10 may further comprise a secondary communications link 42 which may transmit data 23 to an onshore data processor 40 and receive processed data in return, including damage rates and total accumulated damage for individual riser components. Alternatively, system 10 may include one or more shipboard data processors 40.

Still referring to FIG. 1, the subsea sensing and signal unit 31 may in one or more embodiments, comprise one or more motion sensors 37*a* and allied sensor interface units 37*b*, one or more batteries 32 serving as an electric power supply, one or more transducers 33, and one or more acoustic modems 34 configured to convert an electric signal from the transducer into an acoustic signal and propagate it through seawater to the acoustic receiver 38. Additional components of the subsea sensing and signal unit 31 may include one or more memory units 35, and one or more microprocessors 36. The subsea sensing and signal unit may be attached to the riser using various means known in the art such as clamps, tapes, hoops, and the like.

Figure 2:
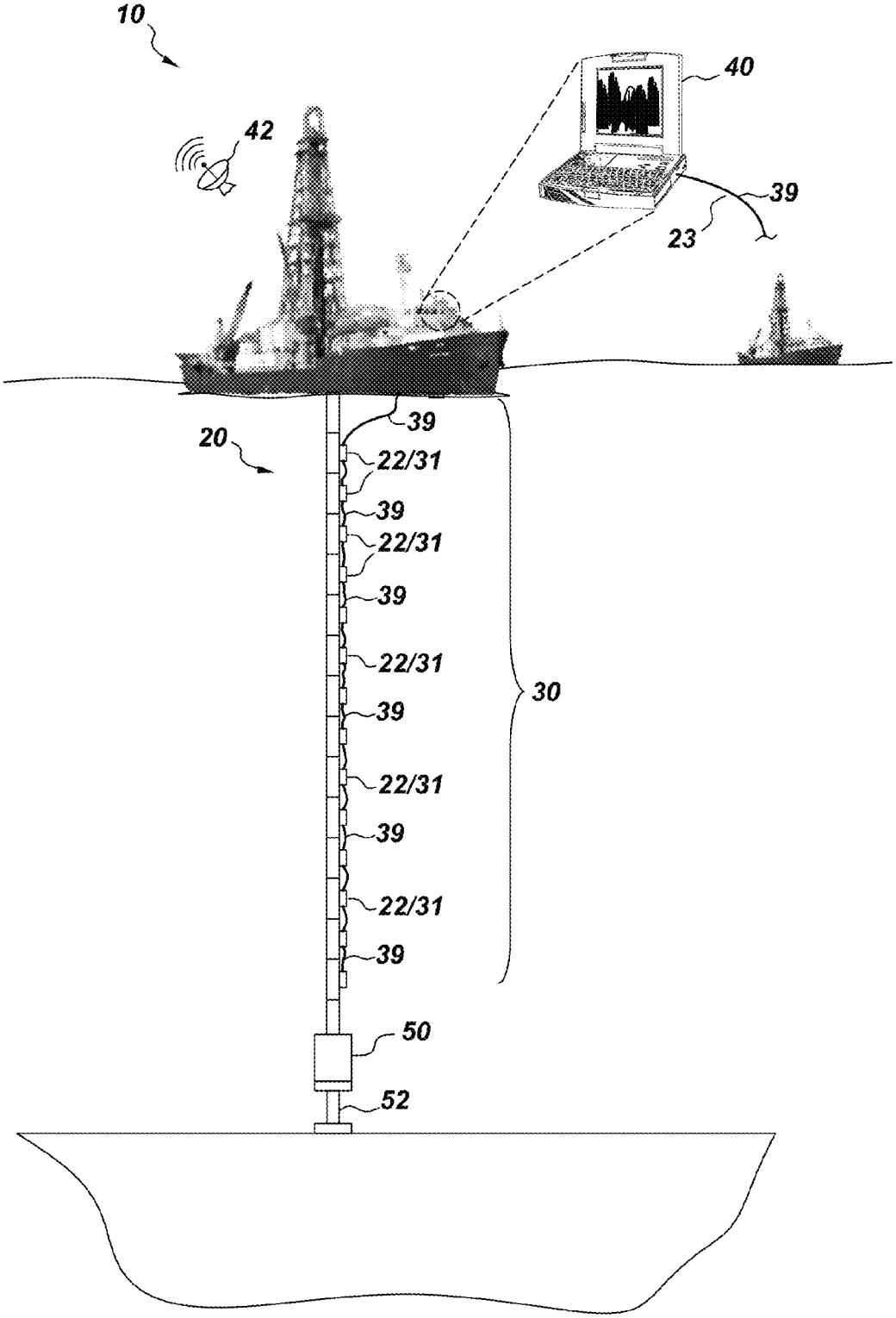
FIG. 2 illustrates one or more embodiments of the present invention.

Referring to FIG. 2, the figure illustrates various embodiments of a system provided by the present invention comprising a hardwired communications link 30. In the embodiment shown, the system 10 may be used for estimating fatigue damage in a riser string 20 linking a subsurface installation comprising a blowout preventer (BOP) 50 and a well head 52. The system comprises a plurality of accelerometers 22 deployed at intervals along the riser string 20. As in FIG. 1, locations along the riser string for which acceleration characteristics are to be estimated (rather than measured by an accelerometer) are designated by element number 24. Accelerometer data 23 are transferred in real time to one or more topside data processors 40 via hardwired communications link 30. Communications link 30 comprises one or more fiber optic cables 39 linking subsea sensing and signal units 31 to the one or more data processors. Sensing and signal units 31 measure the acceleration characteristics of the riser string at each of the limited number of locations along the riser string to which a sensing and signal unit is attached, and may transmit this data in real time, meaning that data 23 may be continuously transmitted, or data may be gathered and stored briefly within the subsea sensing and acoustic unit 31 and then transmitted to the one or more data processors 40.

Still referring to FIG. 2, the subsea sensing and signal unit 31 may in one or more embodiments, comprise one or more motion sensors 37*a* and allied sensor interface units 37*b*, one or more batteries 32 serving as an electric power supply, one or more transducers 33, and one or more optical modems 34 configured to convert an electric signal from the transducer into an optical signal and propagate it through the fiber optic cable 39 to the one or more data processors. Additional components of the subsea sensing and signal unit 31 may include one or more memory units 35, and one or more microprocessors 36. The subsea sensing and signal unit and its one or more associated fiber optic cables may be attached to the riser using various means known in the art such as clamps, tapes, hoops, and the like. In one or more embodiments, sensing and signal units are powered by an electric power umbilical (not shown).

Still referring to FIG. 2, In one or more embodiments, fiber optic cable 39 is a fiber optic sensing cable capable of sensing one or more of an acceleration characteristic, a current intensity characteristic, or a vortex induced vibration characteristic at a plurality of locations along the riser. Under such circumstances, elements in labeled 22/31 in FIG. 2 would correspond to the locations of one or more sensors within the fiber optic sensing cable, for example a Bragg grating capable of sensing one or more of an acceleration characteristic, a current intensity characteristic, or a vortex induced vibration characteristic. Under such circumstances, the fiber optic sensing cable would gather the required data and communicate the same to the one or more data processors 40. In one or more embodiments, the fiber optic sensing cable acts as a fiber optic accelerometer such as are known in the art. See, for example, Baldwin, Chris et al. "Review of fiber optic accelerometers." Proceedings of IMAC XXIII: A Conference & Exposition on Structural Dynamicsm 2005. Fiber optic sensing cables may be advantageously attached to riser structures as disclosed in U.S. patent application Ser. No. 14/558,170 filed Dec. 2, 2014, and which is incorporated herein by reference in its entirety.

Figure 3:
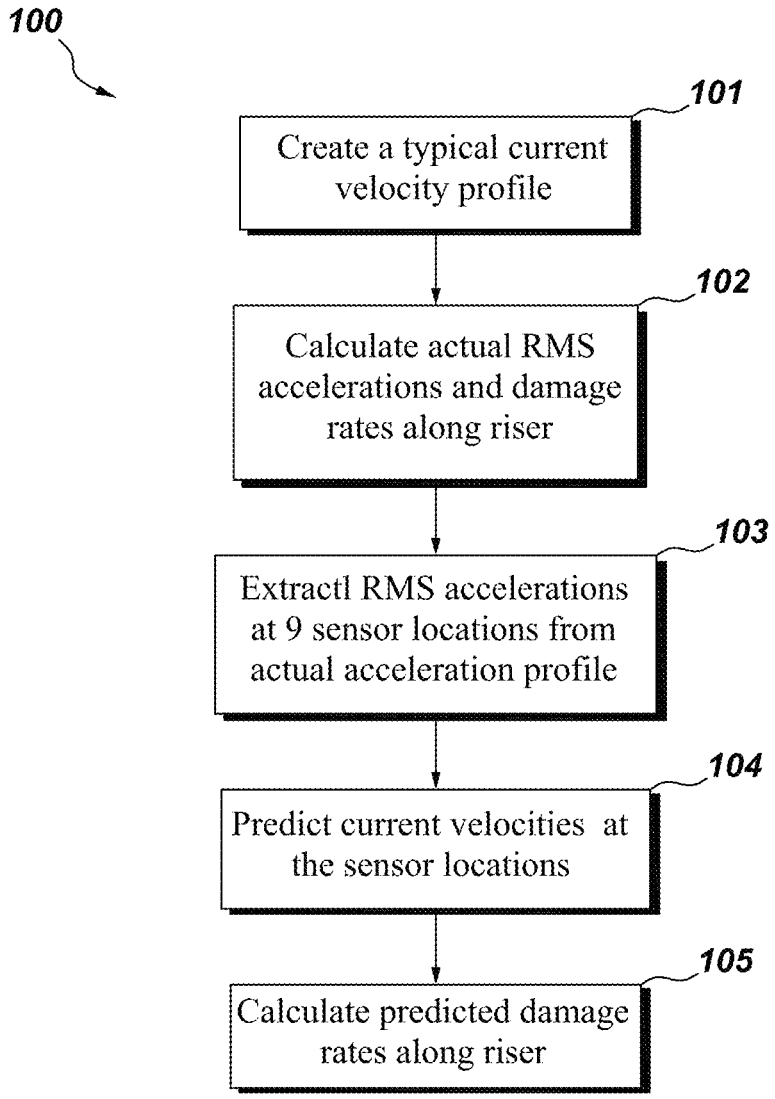
FIG. 3 illustrates methodology used according to one or more embodiments of the present invention.
Figure 4A:
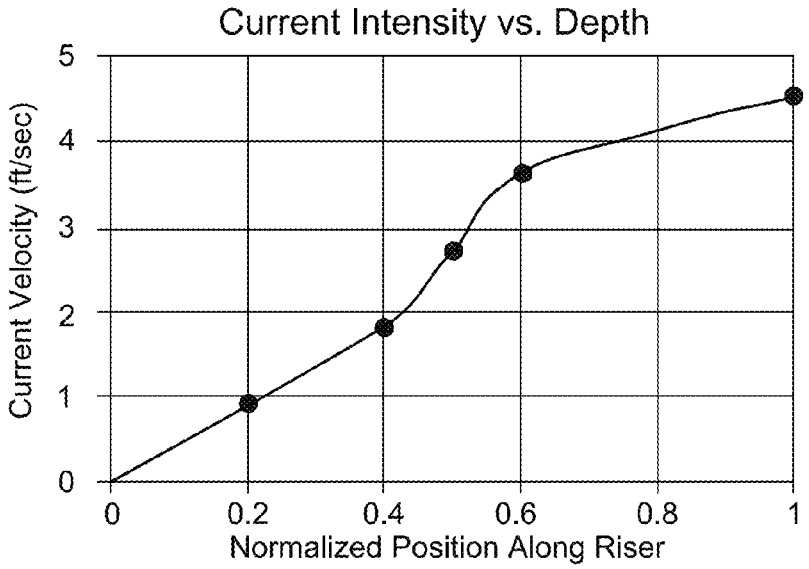
FIG. 4A, FIG. 4B and FIG. 4C illustrate methodology used according to one or more embodiments of the present invention.
Figure 4B:
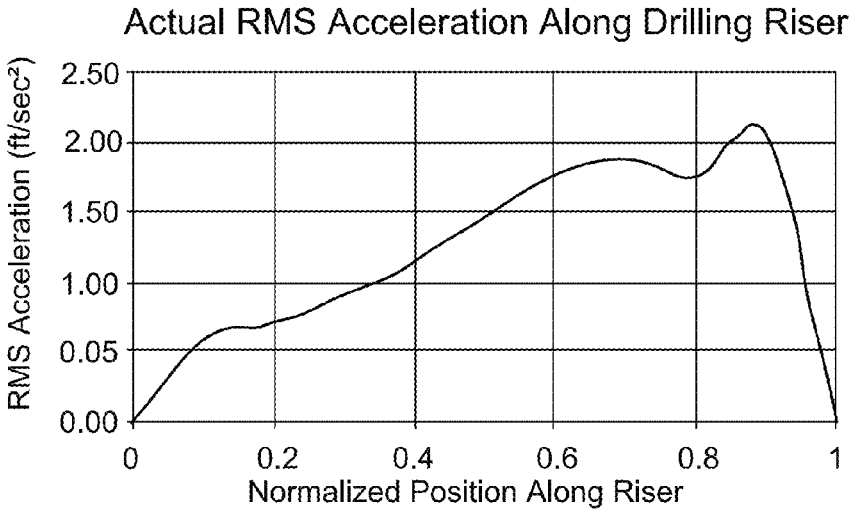
Figure 4C:
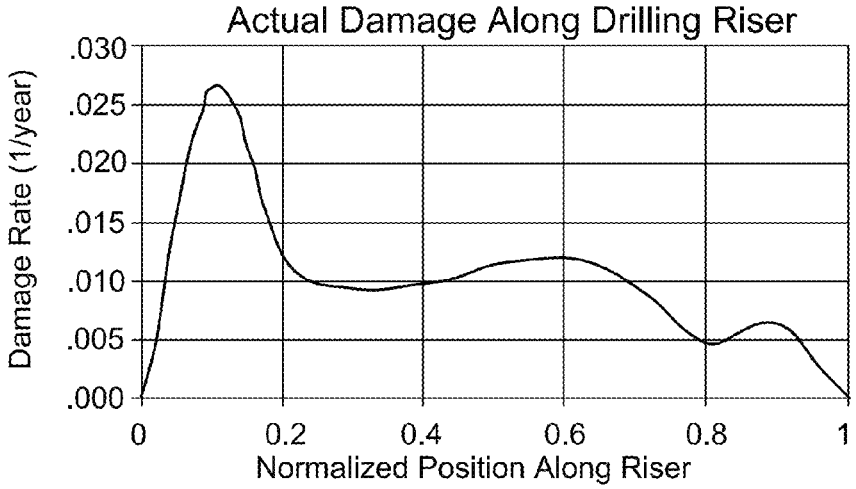

Referring to FIG. 3, the figure illustrates methodology 100 employed in various embodiments of the present invention. In a first step 101 a hypothetical current profile is proposed along the length of a riser string comprising a limited number of subsea sensing and signal units deployed along the length of the riser. In the example illustrated by FIG. 3 there are a total nine such subsea sensing and signal units. (See FIG. 4A) In a second step 102 vibratory accelerations (root mean square (RMS) accelerations), stresses and the associated damage rates that would result from contact between the riser string and the hypothetical current profile extending from the ocean surface to the ocean floor are estimated using one or more suitable finite element codes (See FIG. 4B and FIG. 4C respectively). In a third step 103 acceleration characteristics actually measured at the sensor locations are complied (See FIG. 5A). In a fourth step 104 the measured acceleration characteristics are used to calculate current velocities at the sensor locations, and the differences between the hypothetical current profile and current velocities calculated from measured acceleration characteristics are minimized using one or more neural network models to provide an optimized current profile (See FIG. 5B). In a fifth step 105 the current velocities from the optimized current profile are used to predict damage rates along the entire length of the riser string (See FIG. 5C).

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A system for estimating fatigue damage in a riser string, the system comprising:

(a) a plurality of accelerometers configured to be deployed along a riser string;

(b) a communications link configured to transmit accelerometer data in real time from the plurality of accelerometers; and (c) one or more data processors configured to receive the accelerometer data in real time and to estimate therefrom an optimized hypothetical current profile along the riser string, and to estimate damage rates to individual riser components based upon the optimized hypothetical current profile, and to update a total accumulated damage to individual riser string components, wherein the one or more data processors estimates the optimized hypothetical current profile by using one or more machine learning tools which vary current intensity inputs along the riser string and find closest matches between calculated acceleration characteristics in locations where one of the plurality of accelerometers is present and measured acceleration characteristics reported from said locations.

2. The system according to claim 1, wherein the plurality of accelerometers is less than 20 accelerometers.

3. The system according to claim 1, wherein the communications link is wireless.

4. The system according to claim 3, wherein the communications link is configured to transmit and receive accelerometer data as acoustic signals.

5. The system according to claim 4, wherein the communications link comprises a plurality of subsea sensing and signal units.

6. The system according to claim 5, wherein the subsea sensing and signal units comprise one or more components selected from the group consisting of motion sensors, sensor interface units, batteries, transducers, acoustic modems, memory units, and microprocessors.

7. The system according to claim 6, wherein the communications link comprises an acoustic receiver.

8. The system according to claim 1, wherein the communications link is hard-wired.

9. The system according to claim 8, wherein the communications link comprises a fiber optic cable.

10. The system according to claim 9, wherein the communications link comprises a plurality of subsea sensing and signal units.

11. The system according to claim 10, wherein the subsea sensing and signal units comprise one or more components selected from the group consisting of motion sensors, sensor interface units, transducers, optical modems, memory units, and microprocessors.

12. The system according to claim 10, wherein electric power is provided to the subsea sensing and signal units from one or more batteries.

13. The system according to claim 10, wherein electric power is provided to the subsea sensing and signal units from one or more electric power umbilicals.

14. The system according to claim 1, wherein the one or more machine learning tools comprises a neural network model.

15. The system according to claim 1, wherein the one of more machine learning tools includes one or more neural network models, one or more support vector machines, one or more Bayesian analyses, or a combination of two or more of the foregoing analytical techniques.

16. The system according to claim 1, wherein at least one of the data processors is configured to provide as a system output one or more graphical data summaries.

17. The system according to claim 16, wherein the system output is a graphical data summary displaying total accumulated fatigue along the riser string in real time.

18. The system according to claim 1, wherein the one or more machine learning tools evaluates the vibration modes likely to be excited by vortex shedding in order to predict the localized vortex induced vibration levels used to estimate local damage rates.

19. A system for estimating fatigue damage in a riser string, the system comprising:

(a) a plurality of accelerometers configured to be deployed along a riser string;

(b) a wireless communications link configured to transmit accelerometer data in real time from the plurality of accelerometers;

(c) one or more data processors configured to receive the accelerometer data in real time and to estimate therefrom an optimized hypothetical current profile along the riser string, and to estimate damage rates to individual riser components based upon the optimized hypothetical current profile, and to update a total accumulated damage to individual riser string components;

wherein the one or more data processors estimates the optimized hypothetical current profile by using one or more machine learning techniques which vary current intensity inputs along the riser string and find closest matches between calculated acceleration characteristics in locations where one of the plurality of accelerometers is present and measured acceleration characteristics reported from said locations, and wherein at least one of the data processors is configured to provide as a system output one or more graphical data summaries.

20. The system according to claim 19, wherein the communications link is configured to transmit and receive accelerometer data as acoustic signals.

21. The system according to claim 20, wherein the system output is a graphical data summary displaying total accumulated fatigue along the riser string in real time.

22. A method of producing a hydrocarbon-containing fluid, the method comprising:

(a) drilling a production well while estimating fatigue damage in a riser string using a system comprising:

(i) a plurality of accelerometers deployed along the riser string;

(ii) a communications link transmitting accelerometer data in real time from the plurality of accelerometers; and (iii) one or more data processors receiving the accelerometer data in real time and estimating therefrom an optimized hypothetical current profile along the riser string, and estimating damage rates to individual riser components based upon the optimized hypothetical current profile, and updating a total accumulated damage to individual riser string components;

(b) completing the production well; and (c) causing a hydrocarbon-containing fluid to flow from the production well to a storage facility wherein the one or more data processors estimates the optimized hypothetical current profile by using one or more machine learning tools which vary current intensity inputs along the riser string and find closest matches between calculated acceleration characteristics in locations where one of the plurality of accelerometers is present and measured acceleration characteristics reported from said locations.

* * * * *